US006559838B1

(12) United States Patent
Lonoce et al.

(10) Patent No.: US 6,559,838 B1
(45) Date of Patent: May 6, 2003

(54) POWER MANAGEMENT IN A MONITOR

(75) Inventors: Giovanni Lonoce, Lissone (IT); Alberto Ramolfo, Milan (IT); Augusto Palmero, Monza (IT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/743,996

(22) PCT Filed: May 17, 2000

(86) PCT No.: PCT/EP00/04721

§ 371 (c)(1),
(2), (4) Date: Jan. 17, 2001

(87) PCT Pub. No.: WO00/72296

PCT Pub. Date: Nov. 30, 2000

(30) Foreign Application Priority Data

May 21, 1999 (EP) ..... 99201588

(51) Int. Cl.[7] ..... G09G 5/00

(52) U.S. Cl. ..... 345/212; 345/87; 345/204; 345/211; 345/213; 345/867

(58) Field of Search ..... 345/87, 204, 211, 345/212, 213, 867

(56) References Cited

U.S. PATENT DOCUMENTS 3,976,864 A 8/1976 Gordon et al. ..... 235/153
5,396,635 A * 3/1995 Fung ..... 713/323
5,576,738 A * 11/1996 Anwyl et al. ..... 345/212
5,648,799 A 7/1997 Kikinis ..... 345/212
5,790,096 A * 8/1998 Hill, Jr. ..... 345/600
5,892,959 A * 4/1999 Fung ..... 713/320
5,987,614 A * 11/1999 Mitchell et al. ..... 710/16

FOREIGN PATENT DOCUMENTS

EP 0734010 A2 9/1996 ..... G09G/5/12
EP 0923065 A1 6/1999 ..... G09G/1/16
JP 5344371 12/1993 ..... H04N/3/20
WO WO9715913 5/1997 ..... G09G/5/00

* cited by examiner

*Primary Examiner*—Bipin Shalwala
*Assistant Examiner*—Vincent E. Kovalick
(74) *Attorney, Agent, or Firm*—Edward W. Goodman

(57) ABSTRACT

A power management system includes a detector (1) for generating a transition number (NI) indicating the number of transitions in a video signal (VI) during a selected period in time of the video information (VI). This is repeated in successive periods in time wherein video information (VI) is written to the same area of the display screen (6). In this way, a sequence of transition numbers (NI) occurs representing the number of transitions in the video signal (VI) for the same area of the display screen (6) in successive periods of time. A comparator (3) compares the transition numbers (NI), and a controller (4) activates a power down mode of the monitor when at least two of said transition numbers (NI) is substantially equal, which indicates that the video signal (VI) in the selected area has the same number of transitions in the different time periods, and thus, it is likely that the video signal (VI) did not change.

7 Claims, 3 Drawing Sheets

POWER MANAGEMENT IN A MONITOR

BACKGROUND OF THE INVENTION

1. Field of the Invention

The invention relates to a power management system for a monitor, a method of power management for a monitor, and a display apparatus with such a power management system.

2. Description of the Related Art

In principle, the determination of eventual variations in time of the video signal may be performed by comparing, in any frame, the value of every pixel with the value of the corresponding pixel in the preceding/following frames. Such an approach is known from Japanese Patent Application No. JP-A-5,344,371. This type of solution may be the most efficient one in terms of certainty of comparison, but, on the other hand, it is the most difficult one to realize in practice in that:

- it requires very fast and large memories capable of storing at least one frame;
- it requires a sampling signal at the pixel rate for the video input, which is not available in current analog monitors; and
- it requires A/D converters operating at very high frequencies, leading to possible errors in the sampling in subsequent frames.

SUMMARY OF THE INVENTION

It is, inter alia, an object of the invention to provide power management in a monitor in which variations of a video signal are detected with a less complex circuit which operates at a lower frequency.

To this end, a first aspect of the invention provides a power management system for a monitor having a display screen, the power management system comprising a detector for determining, during successive periods in time, transition numbers indicating a number of transitions in a video signal for a predetermined area of the display screen, a comparator for comparing said transition numbers, and a controller for activating a power down mode of the monitor when at least two of said transition numbers are substantially equal. A second aspect of the invention provides a method of power management for a monitor having a display screen, the power management method comprising the steps of determining, during successive periods in time, transition numbers indicating a number of transitions in a video signal for a predetermined area of the display screen, comparing said transition numbers, and activating a power down mode of the monitor when at least a predetermined number of said transition numbers is substantially equal. A third aspect of the invention provides a display apparatus comprising a power management system as described above.

More particularly, the invention relates to power management in a monitor through the sensing of the steadiness/variation in time of the content of the video signal.

The power management system comprises a detector for determining, during successive periods in time, transition numbers representing a number of transitions in a video signal for a predetermined area of the display screen. Thus, during a period in time of the video information corresponding to part of the video signal which is displayed on the selected area on the display screen, the number of transitions in the video signal are indicated by the transition number. This is repeated in successive periods in time wherein video information is written to the same area of the display screen. In this way, a sequence of transition numbers occurs representing the number of transitions in the video signal for the same area of the display screen in successive periods of time. Two or more transition numbers which are substantially equal in the different time periods, indicate that the video signal in the selected area has the same number of transitions, and thus it is likely that the video signal did not change. Therefore, a comparator compares these transition numbers, and a controller activates a power down mode of the monitor if a sufficient number of transition numbers is equal.

In this way, it is not required to store the values of all the video samples (or pixels) in the selected area for several time periods, and to compare all the corresponding values to determine whether a value of a video sample changed from the one time period to another time period. It suffices to keep track of the number of transitions during each time period. Only a single value per time period needs to be compared. It is possible to compare two or more successive transition numbers to determine whether two or more transition numbers are equal, and if yes, to activate a power down mode of the monitor wherein parts of the monitor or the complete monitor are inactive. It is also possible to continuously compare two successive transition numbers and to keep track of the number of successive transition numbers that are equal. If this number of equal transition numbers surpasses a predetermined value, the power down mode is activated.

A counter counting the number of transitions during the selected time period may generate the transition number which equals the number of transitions occurring during the time period. Alternatively, a pseudo-random generator, also referred to as sequencer, may generate the transition number. Now, the transition number is a pseudo-random number of which the value does not directly provide the number of transitions which occurred during the time period, but which value is indicative for this number of transitions. Such a sequencer may have advantages over a counter.

In an embodiment of the invention characterized in that the predetermined area of the display screen is the whole area covered by a visible part of the video signal, and the successive periods in time are frames of the video signal, each transition number represents the number of transitions in the active part of a complete frame of the video signal. This active part of the frame is displayed as the visible part of the video signal on the screen.

In an embodiment of the invention characterized in that the detector comprises a slicer for supplying a slicer output signal indicating when the video signal crosses a threshold, the slicer compares the video signal with a reference value or level to indicate whether a transition in the video signal occurred. If the video signal is a digital signal, the slicer may compare the samples of the video signal with a reference value. If the video signal is an analog signal, the slicer may compare the video signal with a reference level.

In an embodiment of the invention characterized in that the video signal comprises a first color signal, a second color signal, and a third color signal, the detector comprising a first slicer for receiving the first color signal, and a first pseudo-random generator for receiving an output signal of the first slicer to supply a first sequence of numbers, a second slicer for receiving the second color signal, and a second pseudo-random generator for receiving an output signal of the second slicer to supply a second sequence of numbers, a third slicer for receiving the third color signal, and a third pseudo-random generator for receiving an output signal of the third slicer to supply a third sequence of numbers, the first pseudo-random generator further having an input for receiving an output signal of the third pseudo-random generator such that the first sequence of numbers also depends on the third sequence of numbers, three slicers, and three pseudo-random generators are used, each one to generate the transition number for one of the three color components (also referred to as color signals, usually: the Red, Green and Blue color signals) of the video signal. Each of the slicers compares the color signal sliced with a reference value or level to indicate whether a transition in this color signal occurred. In case of an analog video signal, the slicers may be threshold comparators for converting the analog video levels (for example, in the nominal range 0 . . . 0.7V) in a sequence of digital signals (for example, in the range 0 . . . 5V or 0 . . . 3.3V). Therefore, in any row of the active video, for each of the three colors, a certain number of 0-to-1 or 1-to-0 transitions occur, depending on the picture which is represented on the screen.

A simple counting of these transitions in any frame already provides rough information on the changes of the video content, but this method is unable to detect the eventual changes in the mutual position of the transitions of the three colors among subsequent frames.

To solve this uncertainty, the first step is to introduce, for each color, generators of pseudo-random sequences; these generators behave like counters, but they have the peculiarity that a state has a numerical difference from the previous/following state different than '1'; in the counters, the difference between two subsequent states is always '1'. This means that any stage inside the sequencer does not show a regular alteration of zeroes and ones (like in a traditional counter), but a random stream of bits. If these pseudo-random generators have a width of 16 bits, each of them can accept 65535 transition before the same sequence in the stream restarts.

Keeping these generators independent of each other, the mutual position of transitions is not yet taken into consideration, and the final state still depends only on the number of the transitions in the three colors.

If, in addition, this random behavior is conditioned by the behavior of another color sequencer, a system is realized in which the terminal state (at the end of any selected time period, for example, a frame) of one or each color sequencer depends both on the number of transitions of its own color, and on the sequence of the conditioning color transitions. In this way, the circuit takes into consideration both the number of transitions of each color and their mutual position for each frame.

Such a known pseudo-random generator generates a pseudo-random output number for each input transition. After initializing (resetting) the pseudo-random generator, the output numbers occur in a fixed order, but are not successive numbers. This means that any stage inside the sequencer does not show a regular alternation of zeroes and ones (like in a traditional counter), but a random stream of bits. Such a sequencer is, for example, known from U.S. Pat. No. 3,976,864 as a signature generator for testing a RAMDAC. This patent discloses several embodiments of signature generators. In a first embodiment, the signature generator is a state machine having an internal state which is a function of the input and its own previous internal state, and having an output which is a function only of the internal state. In another embodiment, the state machine is a multi-element shift register which comprises a series of flip-flops of which the output of one flip-flop drives the input of the next. A feedback is provided by adding output bits to the input.

In an embodiment of the invention characterized in that the detector comprises a pseudo-random generator for receiving the slicer output signal to generate a sequence of pseudo-random numbers, and a screen slicer circuit for receiving a line and a frame synchronization signal to supply a screen slicer signal to the pseudo-random generator, the screen slicer output signal having a different value in different area segments of the display screen, a screen slicer has been added. If only the mutual color transitions are considered, regardless of their spatial position in the frame, situations could easily occur in which variations could not be detected. A typical example is the movement of the mouse pointer on a uniform background. To solve this problem, it is necessary to condition the pseudo-random sequence generators by the information of their spatial position. For this purpose, a fourth pseudo-random generator is added to realize the function of the screen slicer. The fourth pseudo-random generator may generate, in each row, a stream of numbers (for example, 256 bits long), in such a way that each row in a frame has a stream different from that of the other rows. In other words, the screen slicer divides the screen vertically in N slices of P rows each (where P=(Vertical Resolution)/N) and horizontally each row in, for example, M pieces so that P*M=256. With reference to this example, the vertical movement of even one line is detected; a horizontal movement is detected if it is bigger than 1/M of a row. It must be considered that 1/256 of a row is represented by approximately 8 pixels at the maximum resolution, and thus, there is a very high probability of detecting any movement of an icon. In a practical implementation, good results were obtained by dividing the lines in 16 segments.

To complete the system, the final state of the three sequencers is stored and compared with the final state of the previous frame, giving, as a result, a 'equal' or 'different' signal. The permanence of this signal in the 'equal' state can be elaborated and consequent actions can be taken.

The invention offers the advantage that it is not required to use signals from a PC which supplies the video signal in the monitor's power management system. An embodiment of the invention is formed by an electronic circuit in the monitor that stores the content of the video signal in numeric form and compares the value with the value of the previous frame. If the values are equal (for two or more successive frames), then a timer is activated that sets the monitor in standby after a selected time period. Otherwise, the timer is reset.

These and other aspects of the invention will be apparent from and elucidated with reference to the embodiments described hereinafter.

The same references in different Figs. refer to the same items.

DESCRIPTION OF THE PREFERRED EMBODIMENTS

Figure 1:
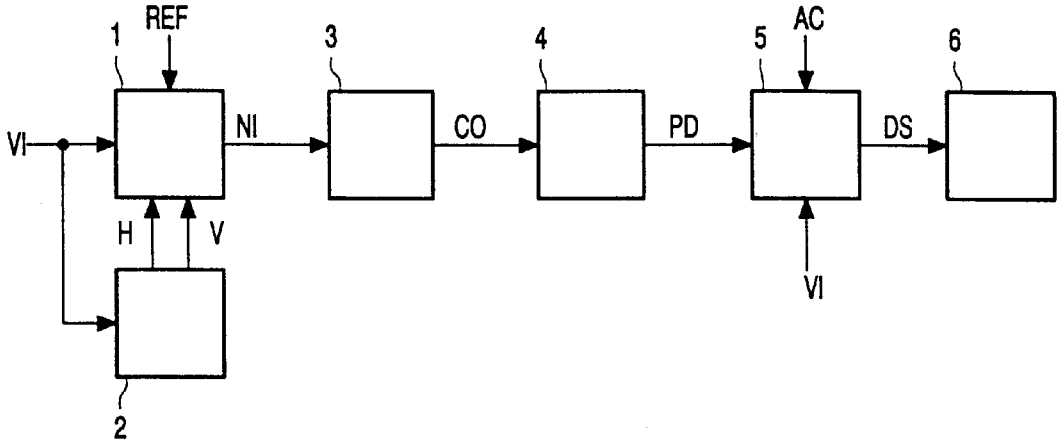
FIG. 1 shows a block diagram of a power management system for a display apparatus in accordance with an embodiment of the invention.

FIG. 1 shows a block diagram of a power management system for a display apparatus in accordance with an embodiment of the invention. A monitor comprises a display screen 6 which, for example, may be a cathode ray tube, or a matrix display device. The monitor further comprises a drive circuit 5 which receives a video signal VI to be displayed on the display screen 6, a line input voltage AC supplying power to the drive circuit 5, and a power down mode signal PD. The drive circuit 5 processes the video signal VI to obtain the drive signal DS for the display screen 6. The drive signal DS comprises RGB signals for driving the display screen 6 such that the amount of red, green and blue light produced is controlled to correspond to the information in the video signal VI. The drive signal DS further comprises drive signals for controlling the addressing of the pixels (or the deflection of the electron beams in a CRT) to correspond with the line H and frame V synchronizing pulses of the video signal VI, such that the video information is displayed at the correct position on the display screen 6. The synchronizing pulses H and V may be part of the video signal VI, or may be separately provided, as for example is the situation by a PC (Personal Computer). The video signal may be a composite video signal or may be separate RGB signals (Red, Green, Blue). The drive circuit 5 comprises a power control circuit (not shown) which receives the power down mode signal PD to selectively power down circuits in the drive circuit 5. For example, the power control circuit switches off the deflection circuits when the power down mode signal PD becomes active. A predetermined period of time later, all circuits of the drive circuit 5 are inactivated except the power control circuit.

The monitor further comprises a power management circuit including a detector 1, a synchronizing circuit 2, a comparator 3 and a controller 4.

The detector 1 receives the video signal VI, the reference Ref, and the line and frame synchronizing signals H and V, and supplies a transition number NI. The detector 1 determines, for a selected period in time, the transition number NI which indicates a number of transitions in the video signal VI for a predetermined area of the display screen 6. Thus, during a period in time of the video information corresponding to part of the video signal VI which is displayed on the selected area on the display screen 6, the number of transitions in the video signal VI are indicated by the transition number NI. This is repeated in successive periods in time wherein video information is written to the same area of the display screen 6. In this way, a sequence of transition numbers NI occurs representing the number of transitions in the video signal VI for the same area of the display screen 6 in successive periods of time. The selected period in time, and thus the area on the display screen 6, is determined from the line and frame synchronization signals H and V which are generated by the synchronizing circuit 2, which may be part of the drive circuit 5. In a preferred embodiment, the selected period in time is the active part of the frame period of the video signal VI. In this way, the power management system determines a single value for each frame, this single value indicating the number of transitions of the video signal in the frame. A transition may be defined as the crossing of a single level, or as the crossing of one of a plurality of levels, wherein each crossing causes a transition. A transition may be determined for a digital video signal by comparing the values of the digital values with one or more reference values Ref. A transition may be determined for an analog video signal by comparing the analog video signal with one or more reference levels Ref.

The comparator 3 compares transition numbers NI of different time periods to generate an output signal CO indicating whether the compared transition numbers are equal or not. The controller 4 generates a power down signal PD to activate a power down mode of the monitor when at least a predetermined number of the transition numbers NI are substantially equal, which indicates that the video signal VI in the selected area has the same number of transitions in the different time periods, and thus, it is likely that the video signal VI did not change.

The detector 1 may comprise a counter counting the number of transitions in the video signal during the selected time period to generate the transition number NI. The transition number NI equals the number of transitions which occur during the time period. Alternatively, the detector 1 may comprise a pseudo-random generator, also referred to as sequencer, for generating the transition number NI. Now, the transition number NI is a pseudo-random number of which the value does not directly provide the number of transitions which occurred during the time period, but the value is indicative for this number of transitions. Such a sequencer is known from prior art, and is elucidated more in detail with respect to FIGS. 3, 4A and 4B. In short, the difference between a sequencer and a counter is that a counter increments its count value at each count pulse received, while a sequencer generates a sequence of pseudo-random numbers. The sequencer has, at any moment, a content which is correlated with what has happened before. With respect to invention, the sequencer has the advantage that its content may easily be influenced by inputs other than the number of transitions to be counted. This will become clear from the description of FIG. 2.

Figure 2:
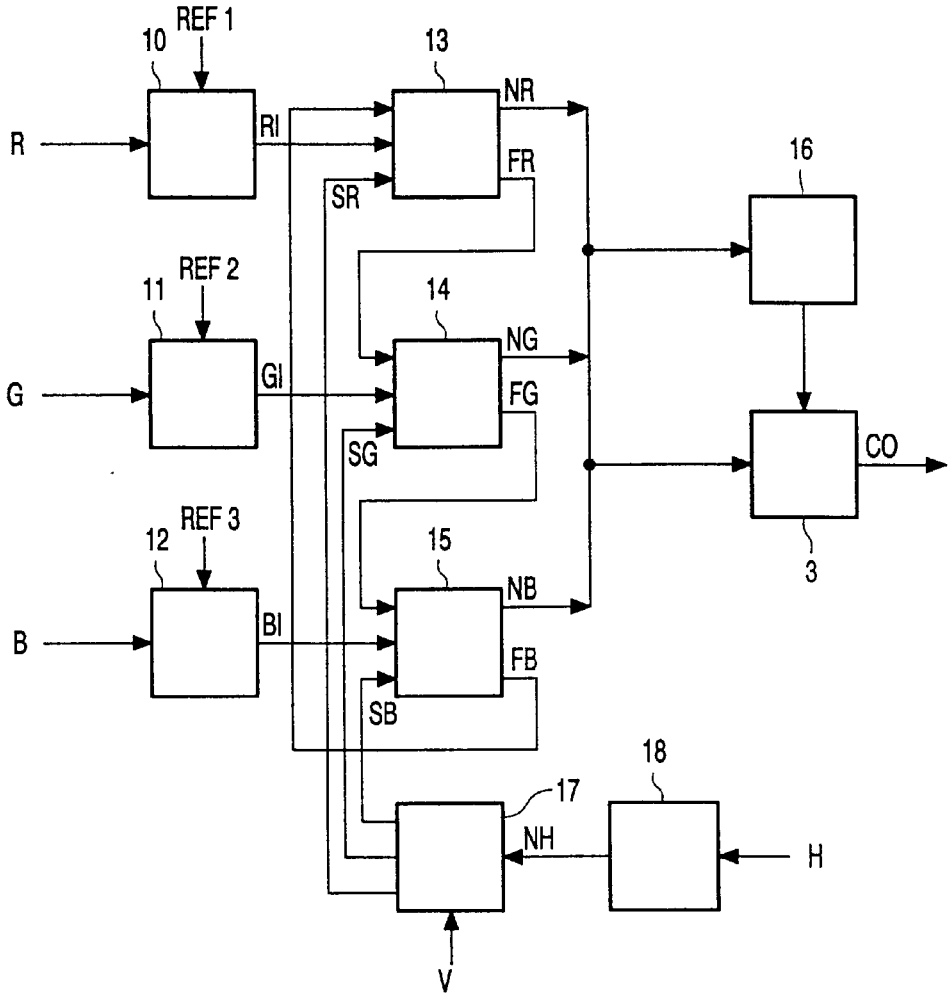
FIG. 2 shows a block diagram of a power management system comprising pseudo-random generators in accordance with an embodiment of the invention.

FIG. 2 shows a block diagram of a power management system comprising pseudo-random generators in accordance with an embodiment of the invention.

The video signal VI comprises the color components (or color signals) R (red), G (green) and B (blue).

A first slicer 10 receives the color signal R and a reference Ref1, and supplies an output signal RI to a first sequencer 13. The first sequencer 13 further receives the input signals FB and SR and supplies the sequence of pseudo-random numbers NR, and an output signal FR which represents an internal state of the sequencer 13.

A second slicer 11 receives the color signal G and a reference Ref2, and supplies an output signal GI to a second sequencer 14. The second sequencer 14 further receives the input signals FR and SG and supplies the sequence of pseudo-random numbers NG, and an output signal FG which represents an internal state of the sequencer 14.

A third slicer 12 receives the color signal B and a reference Ref3, and supplies an output signal BI to a third sequencer 15. The third sequencer 15 further receives the input signals FG and SB and supplies the sequence of pseudo-random numbers NB, and the output signal FB which represents an internal state of the sequencer 15.

The sequences of pseudo-random numbers NR, NG, and NB are supplied to a memory 16 which may be a latch, and the comparator 3. The comparator 3 compares the three pseudo-random numbers NR, NG, and NB, as occurring at the end of a previous frame, with the corresponding three pseudo-random numbers NR, NG, and NB as occurring at the end of the present frame, to detect whether all the corresponding random numbers NR, NG, and NB are equal. The comparator 3 outputs the result of the comparison action as the comparison signal CO.

Each of the sequencers 13, 14, and 15 have three inputs. For the ease of elucidation, the sequencer 13 is selected to be discussed in more detail. The other sequencers 14 and 15 operate in a same manner. The sequencer 13 receives the color component RI, the signal FB from the sequencer 15, and the signal SR from the screen slicer 17. In this way, the random behavior of the sequencer 13 is influenced, or conditioned, by the behavior of the color sequencer 15 and the screen slicer 17. Furthermore, the signal SR conditions the sequencer 13 dependent on the position on the display screen. A system is realized in which the terminal state (the value of the pseudo-random number NR at the end of any selected time period, for example, a frame) of the sequencer 13 depends both on the number of transitions of its own color R, on the sequence of the conditioning color transitions of the color B, and on the position on the display screen 6. Or, in other words, the terminal state depends on the number of transitions of its own color R, on the number of transitions of the other color G, the instants of occurrence of the transitions in the own color R with respect to the instants of occurrence of the transitions of the other color G, and on the segment in which the transitions in the own color R occur. In this way, the circuit takes into consideration, for each frame, both the number of transitions of each color and their mutual position.

The input signals SR, SG, and SB are generated by the screen slicer 17. These input signals SR, SG, and SB indicate area segments on the display screen 6 or corresponding time periods in the video signal VI. For example, for every line, the line period of the video signal is divided into 256 or 16 equally long sub-time periods. The screen slicer 17 is reset by the frame synchronizing signal V and receives an input signal NH which indicates the sub-time periods. The input signal NH may have a repetition frequency, which is an integral times the line frequency, and may be generated by a PLL (phase-locked loop) 18 from the line synchronizing signal H. The screen slicer may generate transitions (a changing value of a bit) which are locked to the line and frame synchronization H, V of the video signal VI. For example, each line of the video signal VI is divided in n segments (for example, as discussed above, 256 or 16), the bit value changes in subsequent segments. These transitions are supplied to the sequencers 13, 14, 15 (for example, are EXOR'd with the color component R, G, B and the feedback transitions FR, FG, FB, see also FIG. 3) and, consequently, the numbers NR, NG, NB supplied by each of the sequencers 13, 14, 15 will depend on the segment in which a particular one of the color component transitions occur.

The slicer may be realized by a sequencer which is reset at the start of every frame, and which produces a pseudo-random number during each segment. In this way, in each frame, the same sequence of pseudo-random numbers SR, SG, SB is generated. The transitions are produced by one bit or a logical function of more bits of the pseudo-random numbers SR, SG, SB.

If the pseudo-random numbers NR, NG and NB indicate the number of transitions in the three colors R, G, and B, respectively, the total number of possible combinations (i.e., the number of possible final states) is given by:

$$(NR+NG+NB)!$$

wherein, for 16 bit sequencers, each Ni can have a value between 0 and 65535. This is a huge number that assures that there is an extremely low possibility that two frames with different content generate the same pseudo-random number Ni.

In a practical implementation, the three sequencers 13, 14 and 15 are 12 to 16 bit long, the latch 16 has 36 to 48 bits to store the value at the end of each frame (through the frame synchronizing signal V), and the comparator has 36 to 48 bits also.

Figure 3:
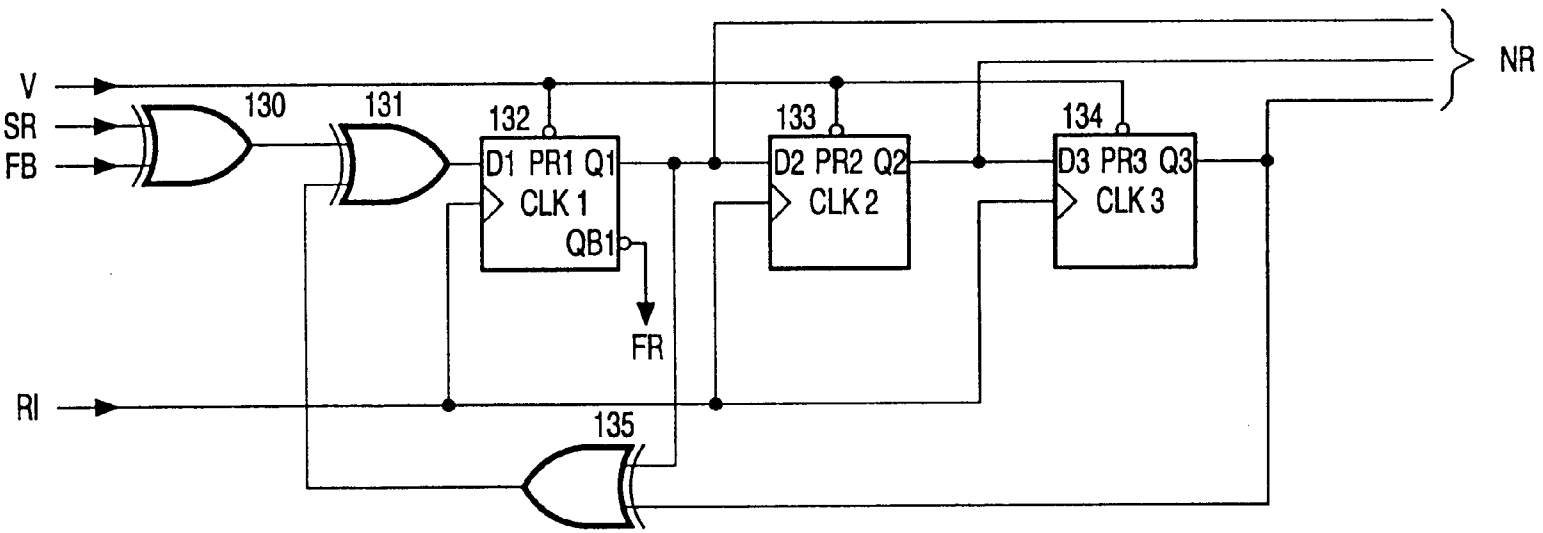
FIG. 3 shows a simplified embodiment of one of the pseudo-random generators of FIG. 2.

FIG. 3 shows a simplified embodiment of one of the pseudo-random generators of FIG. 2.

As an example, the sequencer 13 of FIG. 2 is shown. This sequencer 13 comprises a shift register with three D-type flip-flops 132, 133, 134. The flip-flop 132 has a data input D1, a clock input CLK1, a load input PR1, an output Q1, and an output QB. The flip-flop 133 has a data input D2 connected to the output Q1, a clock input CLK2, a load input PR2, and an output Q2. The flip-flop 134 has a data input D3 connected to the output Q2, a clock input CLK3, a load input PR3, and an output Q3. All load inputs PR1, PR2, PR3 are interconnected to receive the frame synchronization signal V. All clock inputs CLK1, CLK2, CLK3 are interconnected to receive the sliced red signal RI. An EXOR 130 has a first input for receiving the signal SR from the screen slicer 17, a second input for receiving the signal FB from the sequencer 15 for the blue signal B, and an output connected to a first input of the EXOR 131. The EXOR 131 has a further input connected to an output of the EXOR 135, and an output connected to the input D1 of the flip-flop 132. The EXOR 135 has a first input connected to the output Q1 and a second input connected to the output Q3. The outputs Q1, Q2, Q3 are the bits forming the pseudo-random number NR.

Before the start of each frame, first, the shift register is brought in a predetermined starting state. In the shift register shown, the flip-flops 132, 133, 134 are preset by the vertical synchronization signal V to supply a logical 1 at the output Q1, Q2, Q3. Each flip-flop 132, 133, 134 is clocked to store the data at its input D1, D2, D3 at the rising edge of the sliced color signal RI. The data stored depends on: the state of the sequencer 13 as fed back via the EXOR 135, and via the EXOR 130, on both the signal FB which is related to the state of the sequencer 15 for the blue signal B, and the signal SR from the screen slicer 17.

The operation of the power management system of FIG. 2 wherein the pseudo-random generators 13, 14, 15 are mutually influencing each other via the signals FR, FG, and FB, is discussed in general terms in the now following, a more detailed elucidation is presented with respect to FIGS. 4.

A first sequencer 13 receives an input signal D1 which is a logical EXOR function 131, 135 of the detected transitions in a first color component RI of the video signal VI, and a feedback signal FB of a second sequencer 15. The second sequencer 15 receives a second one of the color components B of the video signal VI. The feedback signal FB may be a bit or a logical combination of bits generated by the second sequencer 15. The feedback signal FB logically inverts the data at the data input D1 stored at the transitions in the first color component RI. The first sequencer 13 produces a number NR that depends on the data. Thus, in this way, the pseudo-random numbers NR produced by the first sequencer 13 depend on both the instants of occurrence of transitions in the first color component RI, and the instants of occurrence of transitions in the third color component BI. Or, in other words, the pseudo-random numbers NR produced by the first sequencer 13 are different at an identical first color component signal RI if a transition in the third color signal BI occurs before, instead of after, a predetermined transition in the first color component RI.

Figures 4A, 4B:
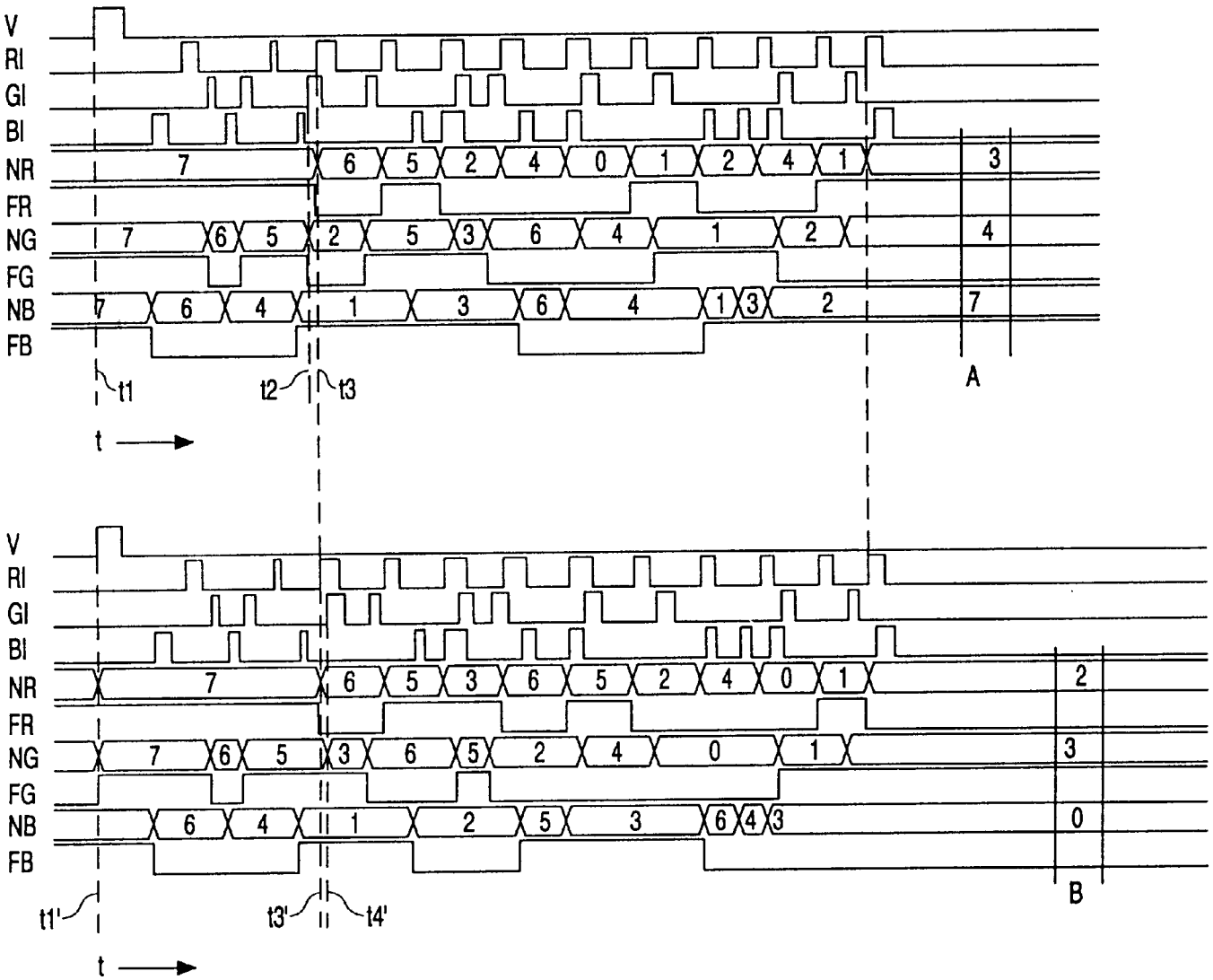
FIGS. 4A and 4B show waveforms elucidating the operation of mutually influencing pseudo-random generators referenced by FIG. 3.

FIGS. 4A and 4B show simulated waveforms elucidating the operation of the mutually influencing pseudo-random generators as shown in FIG. 3. For the ease of explanation, it is assumed that the signal sequences shown occur in the same segment: there is no influence of the screen slicer signals SR, SG, SB. FIGS. 4A and 4B show the vertical synchronization signal V, the sliced color signals RI, GI, BI, the pseudo-random numbers NR, NG, NB, and the feedback signals FR, FG, FB, for a first frame (FIG. 4A) and a second frame (FIG. 4B).

In the first frame (FIG. 4A), starting at the instant t1, a particular rising edge of the signal RI occurs at instant t3, immediately after a particular rising edge of the signal BI which occurs at instant t2. In the second frame (FIG. 4B), starting at instant t1', all rising edges of the signals RI, GI, BI occur at the same relative instants with respect to the instant t1' as the corresponding edges with respect to the instant t1 in the preceding first frame. For example, the time difference between the instants t3' and t1' is equal to the time difference between the instants t3 and t1. The only exception is the rising edge of the signal GI, which, in the second frame, occurs at the instant t4' immediately after the particular rising edge of the signal RI at the instant t3', instead of before the instant t3'. The column A, before the instant t1', shows that the values of the numbers are NR=3, NG=4, NB=7 at the end of the first frame. The column B shows that the values of the numbers at the end of the second frame are NR=2, NG=3, NB=0. The conclusion from this example is that the number NR produced by the sequencer 13 at the end of a frame depends on the mutual position of transitions in the color signal RI (which is the sliced color signal processed by this sequencer 13), and another color signal BI (via the feedback signal FB which depends on the state of a sequencer 15 which processes another sliced color signal BI).

The skilled person will understand that, in a same way, the number NR will depend on the slicer signal SR.

To summarize, a preferred embodiment in accordance with the invention, the solution described in this application proposes the examination of the analog video content of the R, G and B signals in their mutual variations in the crossing of a prefixed analog threshold (both in the raising and in the falling direction) and the subsequent processing of these variations. In contrast with the more general solution in which a frame memory is used, this type of elaboration is less complete, but it is much more simple resulting in a dramatic reduction in the complexity of the circuit and in a lowering of the working frequency.

It should be noted that the above-mentioned embodiments illustrate rather than limit the invention, and that those skilled in the art will be able to design many alternative embodiments without departing from the scope of the appended claims. The sequencers may be implemented in a state machine using memory elements other than D-type flip-flops. The state machine may be implemented in a software algorithm. It may than be required to store successive transition instants of the video signal to lower the speed of operation of the software algorithm. The sequencers may influence each other in another configuration as shown in FIG. 2.

In the claims, any reference signs placed between parentheses shall not be construed as limiting the claim. The word "comprising" does not exclude the presence of other elements or steps than those listed in a claim. The invention can be implemented by means of hardware comprising several distinct elements, and by means of a suitably programmed computer. In the device claim enumerating several means, several of these means can be embodied by one and the same item of hardware.

What is claimed is:

1. A power management system for a monitor having a display screen, the power management system comprising:

a detector for determining, during successive periods in time, transition numbers indicating a number of transitions in a video signal for a predetermined area of the display screen;

a comparator for comparing said transition numbers; and a controller for activating a power down mode of the monitor when at least two of said transition numbers are substantially equal, characterized in that the video signal comprises a first color signal, a second color signal, and a third color signal, and the detector comprises:

a first slicer for receiving the first color signal, and a first pseudo-random generator for receiving an output signal of the first slicer, said first pseudo-random generator supplying a first sequence of numbers;

a second slicer for receiving the second color signal, and a second pseudo-random generator for receiving an output signal of the second slicer, said second pseudo-random generator supplying a second sequence of numbers; and a third slicer for receiving the third color signal, and a third pseudo-random generator for receiving an output signal of the third slicer, said third pseudo-random generator supplying a third sequence of numbers, the first pseudo-random generator further having an input for receiving an output signal of the third pseudo-random generator such that the first sequence of numbers also depends on the third sequence of numbers.

2. A power management system as claimed in claim 1, characterized in that the predetermined area of the display screen is the whole area covered by a visible part of the video signal, and the successive periods in time are frames of the video signal.

3. A power management system for a monitor having a display screen, the power management system comprising:

a detector for determining, during successive periods in time, transition numbers indicating a number of transitions in a video signal for a predetermined area of the display screen, the detector comprising a slicer for supplying a slicer output signal indicating when the video signal crosses a threshold;

a comparator for comparing said transition numbers; and a controller for activating a power down mode of the monitor when at least two of said transition numbers are substantially equal, characterized in that the detector further comprises:

a pseudo-random generator for receiving the slicer output signal, said pseudo-random generator generating a sequence of pseudo-random numbers; and a screen slicer circuit for receiving a line and a frame synchronization signal, and for supplying a screen slicer signal to the pseudo-random generator, the screen slicer output signal having a different value in different area segments of the display screen.

4. The power management system as claimed in claim 3, characterized in that the pseudo-random generator divides a line of the video information in a predetermined number of segments.

5. A power management system as claimed in claim 3, characterized in that the predetermined area of the display screen is the whole area covered by a visible part of the video signal, and the successive periods in time are frames of the video signal.

6. A method of power management for a monitor having a display screen, the power management method comprising the steps of:

determining, during successive periods in time, transition numbers indicating a number of transitions in a video signal for a predetermined area of the display screen;

comparing said transition numbers; and activating a power down mode of the monitor when at least a predetermined number of said transition numbers is substantially equal, characterized in that the video signal comprises a first color signal, a second color signal, and a third color signal, and the determining step comprises the substeps:

slicing the first color signal, and generating a first sequence of pseudo-random numbers in dependence on said sliced first color signal;

slicing the second color signal, and generating a second sequence of pseudo-random numbers in dependence on said sliced second color signal; and slicing the third color signal, and generating a third sequence of pseudo-random numbers in dependence on said sliced third color signal, the first pseudo-random sequence of numbers being further dependent on the third sequence of pseudo-random numbers, the first, second and third sequences of pseudo-random numbers corresponding to first, second and third transition numbers, and said comparing step comprising comparing respective first, second and third transition numbers corresponding to said successive periods in time.

7. A method of power management for a monitor having a display screen, the power management method comprising the steps of:

determining, during successive periods in time, transition numbers indicating a number of transitions in a video signal for a predetermined area of the display screen;

comparing said transition numbers; and activating a power down mode of the monitor when at least a predetermined number of said transition numbers is substantially equal, characterized in that said determining step comprises:

slicing the video signal at a threshold such that said transitions are indicative when said video signal crosses said threshold;

generating a sequence of pseudo-random numbers in dependence said slicing; and slicing a line and a frame synchronization signal, and for generating a screen slicer signal such that said sequence of pseudo-random numbers further depends on the screen slicer signal, the screen slicer output signal having a different value in different area segments of the display screen.

* * * * *